US009323166B2

(12) United States Patent
Kawabe et al.

(10) Patent No.: US 9,323,166 B2
(45) Date of Patent: Apr. 26, 2016

(54) ELECTROPHOTOGRAPHIC TONER

(71) Applicant: Mitsui Chemicals, Inc., Minato-ku, Tokyo (JP)

(72) Inventors: Kuniaki Kawabe, Chiba (JP); Masakazu Tanaka, Ichihara (JP); Hiroshi Matsuoka, Chiba (JP); Noriko Kai, Otake (JP); Keiichi Taki, Tokyo (JP)

(73) Assignee: MITSUI CHEMICALS, INC., Tokyo (JP)

( * ) Notice: Subject to any disclaimer, the term of this patent is extended or adjusted under 35 U.S.C. 154(b) by 30 days.

(21) Appl. No.: 14/387,068

(22) PCT Filed: Mar. 22, 2013

(86) PCT No.: PCT/JP2013/058275
§ 371 (c)(1),
(2) Date: Sep. 22, 2014

(87) PCT Pub. No.: WO2013/146584
PCT Pub. Date: Oct. 3, 2013

(65) Prior Publication Data

US 2015/0044603 A1 Feb. 12, 2015

(30) Foreign Application Priority Data

Mar. 28, 2012 (JP) ..... 2012-074451

(51) Int. Cl.
*G03G 9/097* (2006.01)
*G03G 9/08* (2006.01)
*G03G 9/087* (2006.01)

(52) U.S. Cl.
CPC ..... *G03G 9/08* (2013.01); *G03G 9/08704* (2013.01); *G03G 9/08706* (2013.01); *G03G 9/08708* (2013.01); *G03G 9/08735* (2013.01); *G03G 9/08797* (2013.01); *G03G 9/09733* (2013.01)

(58) Field of Classification Search
CPC ..... G03G 9/08704; G03G 9/08735; G03G 9/08797; G03G 9/09733
USPC ..... 430/108.8
See application file for complete search history.

(56) References Cited

U.S. PATENT DOCUMENTS

| | | | |
|---|---|---|---|
| 5,003,019 | A | 3/1991 | Ishimaru et al. |
| 5,179,171 | A | 1/1993 | Minami et al. |
| 6,162,572 | A | 12/2000 | Fukuzawa et al. |
| 2006/0105260 | A1 | 5/2006 | Lee et al. |

FOREIGN PATENT DOCUMENTS

| | | | |
|---|---|---|---|
| EP | 0 283 164 | A2 | 9/1988 |
| EP | 0 283 164 | A3 | 9/1988 |
| JP | 62-252406 | | 11/1987 |
| JP | 8-114942 | | 5/1996 |
| JP | 9-043891 | | 2/1997 |
| JP | 9-152739 | | 6/1997 |
| JP | 2001-034005 | | 2/2001 |
| JP | 2003-270843 | | 9/2003 |
| JP | 2005-017784 | | 1/2005 |
| JP | 2005-171146 | | 6/2005 |
| JP | 2005-220282 | | 8/2005 |
| JP | 03692577 | B2 | 9/2005 |
| JP | 2006-138978 | | 6/2006 |
| JP | 2007-112863 | | 5/2007 |
| JP | 2010-014949 | | 1/2010 |
| JP | 2010-100843 | | 5/2010 |
| WO | WO-2004/079456 | A1 | 9/2004 |
| WO | WO 2006-051890 | A1 | 5/2006 |

OTHER PUBLICATIONS

European Patent Office (EPO) machine-assisted English-language translation of Japanese Patent 09-152739 (pub. Jun. 1997).*
International Search Report issued in related International Patent Application No. PCT/JP2013/058275, completed Apr. 26, 2013, mailed on May 14, 2013.
Extended European Search Report issued in European Patent Application No. 13768789.3 dated Oct. 28, 2015.

* cited by examiner

*Primary Examiner* — Janis L Dote
(74) *Attorney, Agent, or Firm* — Foley & Lardner LLP

(57) ABSTRACT

The present invention addresses the problem of providing an electrophotographic toner which has excellent storage property, is excellent in offset resistance and low-temperature fixing property during printing and has few substances causing staining with time, odor or dust inside a copy machine or a printer. The present invention relates to an electrophotographic toner characterized by containing an ethylene copolymer which comprises a constituent unit (a) derived from ethylene in an amount of 80 to 99.5% by mol and a constituent unit (b) derived from a cyclic olefin of 8 or more carbon atoms in an amount of 0.5 to 20% by mol [(a)+(b)=100% by mol] and satisfies the requirements: (i) the intrinsic viscosity [η] is in the range of 0.01 to 0.50 dl/g, and (ii) the crystallinity is in the range of 50 to 90%.

6 Claims, No Drawings

ELECTROPHOTOGRAPHIC TONER

CROSS REFERENCE TO RELATED APPLICATIONS

This application is the National Phase of PCT/JP2013/058275, filed Mar. 22, 2013, which claims priority to Japanese Application No. 2012-074451, filed Mar. 28, 2012.

TECHNICAL FIELD

The present invention relates to an electrophotographic toner. More particularly, the present invention relates to an electrophotographic toner containing a specific ethylene-based polymer.

BACKGROUND ART

An electrophotographic toner, namely a so-called electrostatic toner (sometimes also referred to a "toner" simply hereinafter), is used for developing a latent image, which has been formed by charging and exposure, to form a visible image in the electrostatic electrophotography. The toner is a charged fine powder in which a colorant such as carbon black or a pigment is dispersed in a resin. Such toners are broadly divided into a dry type two-component toner that is used together with a carrier such as iron powder or glass particles, a wet type toner that is in a disperse system using an organic solvent such as isoparaffin, a dry type one-component toner in which a magnetic fine powder is dispersed, etc.

By the way, an image obtained on a photoreceptor through the development with a toner is transferred onto paper, or an image directly developed on paper having a photosensitive layer formed thereon is fixed as it is by the use of heat or solvent vapor. Above all, fixing by a heating roller is a fixing method of contact type, so that this fixing method has high thermal efficiency, and even by a heat source of a relatively low temperature, an image can be surely fixed, and further, this method has advantages such as suitability for high-speed copying.

With spread of copy machines and printers in recent years, it is desired that the toners have a further improved image quality, in addition the toners are able to apply for high-speed printing, and toners have an excellent fixing property at low-energy. Therefore, toners having improved fixing property at low temperature are developed. For example, waxes of low melting points have been used (patent literatures 1 and 2) for the purposes of low temperature fixing of the toners.

CITATION LIST

Patent Literature

Patent literature 1: Japanese Patent Laid-Open Publication No. 1996-114942

Patent literature 2: Japanese Patent Laid-Open Publication No. 2010-014949

SUMMARY OF INVENTION

Technical Problem

In a heating environment during toner production or printing, however, there is a possibility that a toner binder resin containing a low-melting point wax is diffused at least partially because of sublimation, or there is a possibility that the resin is thermally decomposed to suffer further lowering of a molecular weight.

Therefore, the toner containing a low-melting point wax is liable to suffer lowering of storage property such as stickiness or blocking of toner particles in a storage period after toner production, and there is a fear that such a toner causes stain or dust (staining substance) inside a copy machine or a printer during printing or the toner is scattered outside the apparatus to deteriorate the workplace environment.

On the other hand, by the use of a wax of a high melting point instead of a low-melting point wax, it is possible to reduce a volatile substance, but the low-temperature fixing property as toner performance tends to be lowered. That is to say, high-speed printing suitability or low-energy fixing property is markedly impaired, and as a result, it is difficult to satisfy both requirements of toner performance and reduction of staining.

The present invention addresses the problem of providing an electrophotographic toner which has excellent storage property, is excellent in offset resistance and low-temperature fixing property during printing and has few substances causing staining with time or dust inside a copy machine or a printer.

Solution to Problem

In order to solve the above problem, the present inventors have earnestly studied. As a result, they have found that the above problem can be solved by incorporating an ethylene-based polymer containing a specific structure and satisfying specific requirements into an electrophotographic toner, and they have accomplished the present invention.

That is to say, the present invention relates to the following [1] to [6].

[1] An electrophotographic toner containing an ethylene copolymer which comprises a constituent unit (a) derived from ethylene in an amount of 80 to 99.5% by mol and a constituent unit (b) derived from a cyclic olefin of 8 or more carbon atoms in an amount of 0.5 to 20% by mol [(a)+(b)=100% by mol] and satisfies the following requirements (i) and (ii):

(i) the intrinsic viscosity [η] is in the range of 0.01 to 0.50 dl/g, and (ii) the crystallinity is in the range of 50 to 90%.

[2] The electrophotographic toner as stated in [1], wherein the ethylene copolymer further satisfies the following requirements (iii) and (iv):

(iii) the melting point (Tm) as measured by a differential scanning calorimeter (DSC) is in the range of 50 to 100° C., and (iv) the molecular weight distribution (Mw/Mn) as measured by GPC is in the range of 1 to 3.

[3] The electrophotographic toner as stated in [1] or [2], wherein the constituent unit (b) derived from a cyclic olefin of 8 or more carbon atoms contains 2 or more double bonds.

[4] The electrophotographic toner as stated in any one of [1] to [3], wherein the constituent unit (b) derived from a cyclic olefin of 8 or more carbon atoms contains a repeating unit represented by the following general formula (V):

[Chem. 1]

(V)

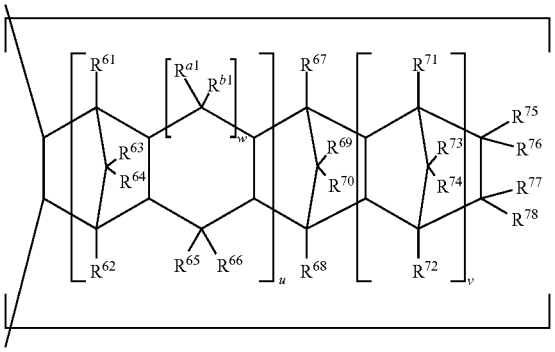

wherein u is 0 or 1, v is 0 or a positive integer, w is 0 or 1, $R^{61}$ to $R^{78}$, $R^{a1}$ and $R^{b1}$ may be the same as or different from one another and are each a hydrogen atom, a halogen atom, an alkyl group of 1 to 20 carbon atoms, an alkenyl group of 1 to 20 carbon atoms, a halogenated alkyl group of 1 to 20 carbon atoms, a cycloalkyl group of 3 to 15 carbon atoms or an aromatic hydrocarbon group of 6 to 20 carbon atoms, and $R^{75}$ to $R^{78}$ may be bonded to each other to form a monocyclic ring, a polycyclic ring or a multiple bond, but when u and v are both 0, at least one of $R^{67}$ to $R^{70}$ and $R^{75}$ to $R^{78}$ is an alkenyl group or a multiple bond other than a hydrogen atom.

[5] The electrophotographic toner as stated in any one of [1] to [4], wherein the constituent unit (b) derived from a cyclic olefin of 8 or more carbon atoms is ethylidene norbornene (ENB) or vinyl norbornene (VNB).

[6] An electrophotographic toner which is the electrophotographic toner as stated in any one of [1] to [5] that comprises a polyester resin or a styrene-based polymer as a binder resin.

Advantageous Effects of Invention

According to the present invention, an electrophotographic toner which has excellent storage property, is excellent in offset resistance and low-temperature fixing property during printing and has few substances causing staining with time or dust inside a copy machine or a printer can be provided.

DESCRIPTION OF EMBODIMENTS

<Ethylene Copolymer>

The ethylene copolymer to constitute the electrophotographic toner (sometimes also referred to as a "toner" simply hereinafter) of the present invention is a copolymer comprising a constituent unit (a) derived from ethylene in an amount of 80 to 99.5% by mol and a constituent unit (b) derived from a cyclic olefin of 8 or more carbon atoms in an amount of 0.5 to 20% by mol [(a)+(b)=100% by mol] and having (i) an intrinsic viscosity [η] ranging from 0.01 to 0.50 dl/g and (ii) a crystallinity ranging from 50 to 90%.

The ethylene copolymer in the present invention comprises a constituent unit (a) derived from ethylene preferably in an amount of not less than 85% by mol, more preferably not less than 90% by mol, particularly preferably not less than 95% by mol, and preferably in an amount of not more than 99% by mol, more preferably not more than 98.5% by mol, particularly preferably not more than 98% by mol, and comprises a constituent unit (b) derived from a cyclic olefin of 8 or more carbon atoms preferably in an amount of not less than 1% by mol, more preferably not less than 1.5% by mol, particularly preferably not less than 2% by mol, and preferably in an amount of not more than 15% by mol, more preferably not more than 10% by mol, particularly preferably not more than 5% by mol [ (a)+(b)=100% by mol].

In the present invention, the amounts of the constituent units can be determined by the method described in the later-described working examples.

The ethylene copolymer containing the constituent unit (a) derived from ethylene and the constituent unit (b) derived from a cyclic olefin of 8 or more carbon atoms in the above-mentioned proportions not only improves storage property of a toner, offset resistance during printing and low-temperature fixing property but also can reduce odor generated from a toner and staining with time.

In general, it is considered that in an ethylene polymer, scission of an ethylene structural unit that is usually a chain structure or a structural unit portion of an α-olefin that is included as needed because of heat or the like to induce lowering of a molecular weight. Further, it is said that scission is relatively liable to occur at a moiety related to the α-olefin structural unit. Moreover, it is presumed that when the α-olefin structural unit is introduced, motility for a polymer chain is enhanced, and also from this viewpoint, a possibility of receiving scission is increased.

In contrast therewith, it is presumed that since the ethylene copolymer in the present invention contains a cyclic structure composed of the constituent unit (b) derived from a cyclic olefin of 8 or more carbon atoms in the aforesaid proportion, as previously described, rigidity of a polymer is increased and motility of the polymer is decreased, and as a result, the ethylene copolymer rarely undergoes decomposition caused by heat. Furthermore, when a cyclic olefin having 2 or more double bonds in a molecule is used, there is a possibility that a part of it is crosslinked under heating, and further increase in rigidity of a polymer can be expected. Moreover, it is considered that in the case where a cyclic olefin particularly having such a structure as represented by the general formula (V) is used, even if scission of a C—C bond that constitutes a main chain occurs, scission of a polymer chain is not reached by virtue of other cyclic structure portions, so that lowering of a molecular weight can be inhibited.

From these matters, it is considered that in the later-described toner of the present invention, though it contains an ethylene polymer of a low melting point, lowering of a molecular weight is little in a heating environment during toner production or printing, and formation of a low-molecular weight component that can become a cause of blocking, odor or the like is reduced, so that the aforesaid excellent effects can be obtained, that is, storage property of a toner, offset resistance during printing and low-temperature fixing property are enhanced, and odor generated from a toner and staining with time can be reduced.

The ethylene copolymer in the present invention has (i) an intrinsic viscosity [η] ranging from 0.01 to 0.50 dl/g. The intrinsic viscosity [η] of the ethylene copolymer of the present invention is preferably not less than 0.02 dl/g, more preferably not less than 0.03 dl/g, particularly preferably not less than 0.04 dl/g, and is preferably not more than 0.20 dl/g, more preferably not more than 0.15 dl/g, particularly preferably not more than 0.10 dl/g.

By the use of an ethylene copolymer having an intrinsic viscosity [η] of not less than the above lower limit, the resulting toner has excellent offset resistance, and by the use of an ethylene copolymer having an intrinsic viscosity [η] of not more than the above upper limit, the resulting toner has excellent fixing property.

The ethylene copolymer in the present invention has (ii) a crystallinity ranging from 50 to 90%. The crystallinity of the ethylene copolymer in the present invention is preferably not less than 60%, more preferably not less than 70%, particularly preferably not less than 75%, and is not more than 90%, preferably not more than 88%, more preferably not more than 87%, particularly preferably not more than 86%.

By the use of an ethylene copolymer having a crystallinity of not less than the above lower limit, the resulting toner has excellent offset resistance.

The ethylene copolymer in the present invention is preferably a copolymer further satisfying the following requirements (iii) and (iv) in addition to the above requirements (i) and (ii).

(iii) The melting point (Tm) as measured by a differential scanning calorimeter (DSC) is in the range of 50 to 100° C.

The melting point (Tm) of the ethylene copolymer in the present invention is more preferably not lower than 60° C., still more preferably not lower than 65° C., particularly preferably not lower than 70° C., and is more preferably not higher than 90° C., still more preferably not higher than 88° C., particularly preferably not higher than 86° C.

When the ethylene copolymer having a melting point in the above range is used, a toner having excellent heat resistance and releasability can be obtained.

(iv) The molecular weight distribution (Mw/Mn) as measured by gel permeation chromatography (GPC) is in the range of 1 to 3.

Mw/Mn of the ethylene copolymer in the present invention is desired to be more preferably not more than 3.0, still more preferably not more than 2.0.

The ethylene copolymer having a molecular weight distribution in the above range is expected to be reduced in stickiness of the ethylene copolymer itself, and such reduction of stickiness is sometimes more preferable from the viewpoint of enhancement of storage property and development durability of the resulting toner.

The weight-average molecular weight (Mw) and the number-average molecular weight (Mn) are values in terms of polyethylene, which are measured by GPC. The measurement by GPC is carried out under the conditions of a temperature of 140° C. and a solvent of o-dichlorobenzene.

The ethylene copolymer in the present invention may contain a constituent unit (c) derived from at least one olefin selected from α-olefins of 3 to 20 carbon atoms other than cyclic olefins of 8 or more carbon atoms, in addition to the constituent unit (a) derived from ethylene and the constituent unit (b) derived from a cyclic olefin of 8 or more carbon atoms.

When the ethylene copolymer in the present invention contains the constituent unit (c), the constituent unit (c) is contained in an amount of 0.01 to 15% by mol. The lower limit is more preferably 0.05% by mol, particularly preferably 0.1% by mol, and the upper limit is more preferably 8% by mol, particularly preferably 5% by mol [(a)+(b)+(c)=100% by mol].

By the use of the ethylene copolymer containing the constituent unit (c) in a proportion of the above range, a toner having an excellent balance between heat resistance and releasability can be obtained.

The amounts of the constituent unit (a), the constituent unit (b), the constituent unit (c), etc. of the ethylene copolymer in the present invention can be determined by the method described in Examples.

<<Constituent Unit (b) Derived from Cyclic Olefin of 8 or More Carbon Atoms>>

The constituent unit (b) derived from a cyclic olefin of 8 or more carbon atoms, which constitutes the ethylene copolymer in the present invention, is derived by copolymerizing a cyclic olefin of 8 or more carbon atoms.

As the cyclic olefin of 8 or more carbon atoms in the present invention, a cyclic olefin having at least one double bond in a molecule is preferably used.

The cyclic olefin having one double bond in a molecule is specifically a cyclic olefin preferably having 8 to 20 carbon atoms, more preferably 8 to 15 carbon atoms, such as 5-methyl-2-norbornene, tetracyclododecene or vinylcyclohexane.

The constituent unit (b) derived from a cyclic olefin of 8 or more carbon atoms more preferably contains 2 or more double bonds. Therefore, as the cyclic olefin of 8 or more carbon atoms, a cyclic olefin having 2 or more double bonds in a molecule is more preferable.

As the cyclic olefin having 8 or more carbon atoms and having at least two double bonds in a molecule (cyclic polyene), a cyclic olefin which derives a repeating unit represented by the later-described general formula (V) is preferable. Specifically, there can be mentioned cyclic non-conjugated dienes represented by the later-described chemical formulas, and cyclic olefins of 8 to 20 carbon atoms, preferably 8 to 10 carbon atoms, such as dicyclopentadiene, dicyclooctadiene, methylene norbornene, 5-vinyl norbornene, 5-ethylidene-2-norbornene, 5-methylene-2-norbornene, 5-isopropylidene-2-norbornene, 6-chloromethyl-5-isopropenyl-2-norbornene, 2,3-diisopropylidene-5-norbornene, 2-ethylidene-3-isopropylidene-5-norbornene and 2-propenyl-2,2-norbornadiene.

Of the above cyclic olefins, ethylidene norbornene (ENB) or vinyl norbornene (VNB) is particularly preferable from the viewpoints of heat resistance for a cyclic olefin and storage property of a toner. Of these, non-conjugated polyenes, such as methylene norbornene, 5-vinyl norbornene, 5-ethylidene-2-norbornene, 5-methylene-2-norbornene, 5-isopropylidene-2-norbornene, 6-chloromethyl-5-isopropenyl-2-norbornene, 2,3-diisopropylidene-5-norbornene, 2-ethylidene-3-isopropylidene-5-norbornene and 2-propenyl-2,2-norbornadiene, are preferable, and 5-vinyl norbornene and 5-ethylidene-2-norbornene are particularly preferable.

In the present invention, aromatic vinyl compounds are included in the cyclic olefins. Examples of the aromatic vinyl compounds include styrene, and mono- or poly-alkylstyrenes, such as α-methylstyrene, o-methylstyrene, m-methylstyrene, p-methylstyrene, o,p-dimethylstyrene, o-ethylstyrene, m-ethylstyrene and p-ethylstyrene.

The cyclic olefins may be used singly, or may be used in combination of two or more kinds.

The constituent unit (b) derived from a cyclic olefin of 8 or more carbon atoms can contain a repeating unit represented by the following general formula (V).

[chem. 2]

(V)

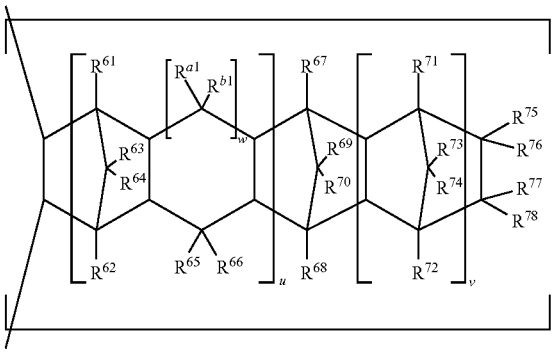

In the general formula (V), u is 0 or 1, v is 0 or a positive integer, w is 0 or 1, $R^{61}$ to $R^{78}$, $R^{a1}$ and $R^{b1}$ may be the same as or different from one another and are each a hydrogen atom, a halogen atom, an alkyl group of 1 to 20 carbon atoms, an alkenyl group of 1 to 20 carbon atoms, a halogenated alkyl group of 1 to 20 carbon atoms, a cycloalkyl group of 3 to 15 carbon atoms or an aromatic hydrocarbon group of 6 to 20 carbon atoms, and $R^{75}$ to $R^{78}$ may be bonded to each other to form a monocyclic ring, a polycyclic ring or a multiple bond, but when u and v are both 0, at least one of $R^{67}$ to $R^{70}$ and $R^{75}$ to $R^{78}$ is an alkenyl group or a multiple bond other than a hydrogen atom.

A raw material for the repeating unit represented by the general formula (V) is not specifically restricted, but for example, cyclic non-conjugated dienes represented by the following chemical formulas can be mentioned.

[chem. 3]

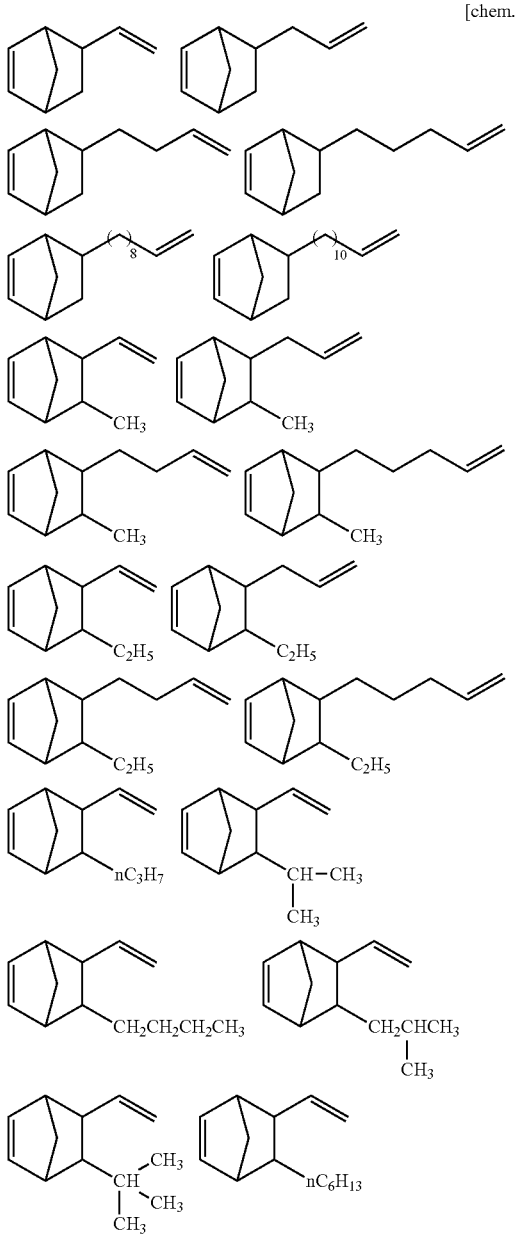

-continued

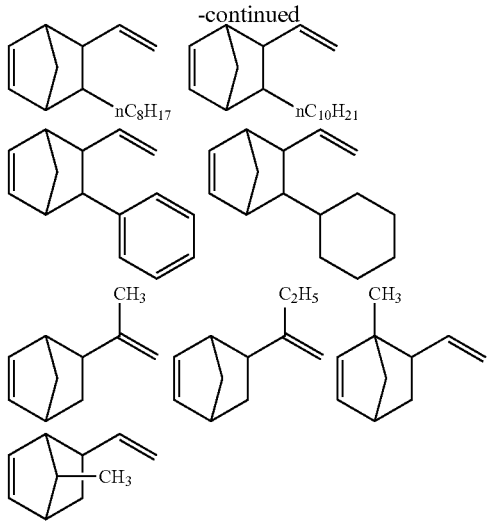

[Chem. 4]

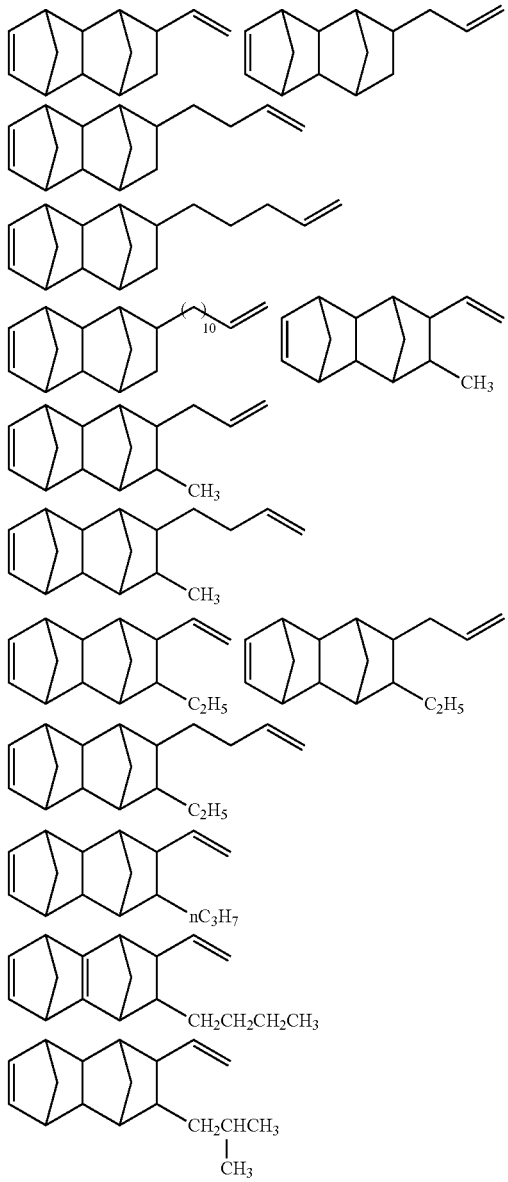

-continued

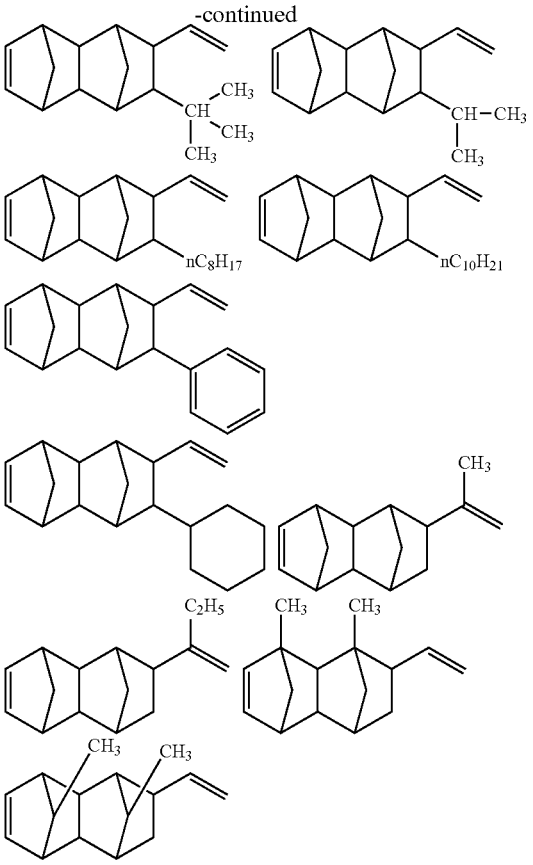

<<Constituent Unit (c) Derived from at Least One Olefin Selected from α-Olefins of 3 to 20 Carbon Atoms>>

The constituent unit (c) derived from at least one olefin selected from α-olefins of 3 to 20 carbon atoms other than the cyclic olefins of 8 or more carbon atoms in the present invention is derived by copolymerizing at least one olefin selected from α-olefins of 3 to 20 carbon atoms.

The α-olefins of 3 to 20 carbon atoms in the present invention are, for example, straight-chain or branched α-olefins.

Specifically, there can be mentioned, for example, straight-chain α-olefins of 3 to 20 carbon atoms, preferably 3 to 10 carbon atoms, such as propylene, 1-butene, 1-pentene, 1-hexene, 1-octene, 1-decene, 1-dodecene, 1-tetradecene, 1-hexadecene, 1-octadecene and 1-eicosene; 3-methyl-1-butene, 3-methyl-1-pentene, 3-ethyl-1-pentene, 4,4-dimethyl-1-pentene, 4-methyl-1-hexene, 4,4-dimethyl-1-hexene, 4-ethyl-1-hexene and 3-ethyl-1-hexene. Of these, preferable are α-olefins of 3 to 10 carbon atoms, more preferable are α-olefins of 3 to 6 carbon atoms, and particularly preferable is propylene.

The straight-chain or branched α-olefins of 3 to 20 carbon atoms may be used singly, or may be used in combination of two or more kinds.

<Production Process for Ethylene Copolymer>

The ethylene copolymer in the present invention can be produced by various production processes publicly known, such as a process comprising polymerizing ethylene and a cyclic olefin of 8 or more carbon atoms, and if necessary, an α-olefin of 3 to 20 carbon atoms other than a cyclic olefin of 8 or more carbon atoms, using a Ziegler-Natta catalyst or a metallocene catalyst.

The ethylene copolymer in the present invention may be an ethylene copolymer obtained by directly polymerizing ethylene, etc., or may be an ethylene copolymer obtained by thermal decomposition of a high-molecular weight ethylene copolymer Of such catalysts, a metallocene catalyst is preferable. As the metallocene catalyst, preferably used is, for example, a catalyst constituted of a metallocene compound of a transition metal selected from the periodic table Group 4 and an organoaluminim oxy-compound and/or an ionizing ionic compound (Japanese Patent Laid-Open Publication No. 2005-171146).

The intrinsic viscosity [η] of the ethylene copolymer tends to be decreased by raising the polymerization temperature during polymerization or by increasing the hydrogen concentration, and it can be controlled to be in the aforesaid range.

The content of the unit derived from a cyclic olefin of 8 or more carbon atoms can be controlled not only by adjusting the amount of the cyclic olefin of 8 or more carbon atoms added in the polymerization but also by the catalyst species, the polymerization temperature or the like.

When the ethylene copolymer is produced by the use of, for example, a metallocene catalyst described in the later-described polymerization example, the number of cyclic structures based on 1000 carbon atoms can be increased by increasing the amount of the constituent unit (b) introduced. The polymerization temperature is usually in the range of 10 to 200° C., but from the viewpoint of production of an ethylene-based polymer containing the unit derived from a cyclic olefin in an amount of the aforesaid preferred range, the polymerization temperature is preferably in the range of 60 to 180° C., more preferably 75 to 170° C.

The crystallinity of the ethylene copolymer can be controlled to be in the aforesaid range by controlling the content of the constituent unit (a) derived from ethylene in the ethylene copolymer.

The melting point of the ethylene copolymer can be controlled to be in the aforesaid range in the following manner. That is to say, the melting point can be lowered by increasing the content of the constituent unit (b), or the melting point can be also controlled by the catalyst species, the polymerization temperature or the like.

The molecular weight distribution (Mw/Mn) of the ethylene copolymer can be controlled to be in the aforesaid range by the catalyst species, the polymerization temperature or the like. In general, a Ziegler-Natta catalyst or a metallocene catalyst is used for the polymerization for an ethylene copolymer, but in order to obtain Mw/Mn of the preferred range, it is preferable to use a metallocene catalyst.

To the ethylene copolymer in the present invention, additives, such as weathering stabilizer, heat stabilizer, antistatic agent, anti-slip agent, anti-blocking agent, anti-fogging agent, nucleating agent, lubricant, pigment, dye, plasticizer, anti-aging agent, hydrochloric acid absorbent, antioxidant, copper inhibitor and filler, may be added within limits not detrimental to the object of the present invention, when needed.

The ethylene copolymer in the present invention is an additive for toners. Moreover, it can be applied to various uses, e.g., various additives, such as additive for coating materials, polishing agent, fluidity improver for various thermoplastic resins or thermosetting resins (typically polyolefins and engineer plastics), resin strength improver, resin compatibilizing agent, resin lubricant, resin hardness/melting point adjusting agent, mold release agent for resin molding, processing aid for rubbers, antioxidant for rubbers, paper quality improver, additives such as anti-wear additive for printing ink and leveling agent; additive for thermal transfer ink, fiber processing aid, additive for hot melt adhesives, electrical insulating agent, additive for natural waxes, anti-fogging agent for polyolefin films, pigment dispersing agent, dispersing agent for pigment master batch, molding processing aid, paper coating, emulsion component, additive for floor polishing, fiber finishing agent, lubricant for polyvinyl chloride, additive for asphalt, nucleating agent for expanded polystyrene, additive for lost wax, one component of candle, additive for electrical cable compound, and intermediate raw materials for various reactions such as air oxidation, acid modification, silicone modification, amination and esterification.

<Electrophotographic Toner>

The toner of the present invention comprises the ethylene copolymer.

The toner of the present invention contains, in addition to the ethylene copolymer, a binder resin for a toner and a publicly known colorant, and if necessary, further contains a charge controlling agent, a mold release agent, a pigment dispersing agent, etc.

<<Binder Resin for Toner>>

As the binder resin for a toner in the present invention, any of various binder resins publicly known can be used. Specific examples of such resins include styrene-based polymer, ketone resin, maleic acid resin, polyester resins such as aliphatic polyester resin, aromatic polyester resin and aliphatic-aromatic polyester resin, coumarone resin, phenolic resin, epoxy resin, terpene resin, polyvinyl butyral, polybutyl methacrylate, polyvinyl chloride, polyethylene, polypropylene, polybutadiene and ethylene/vinyl acetate copolymer.

These binder resins for toner may be used singly, or may be used in combination of two or more kinds. Of the above binder resins for toner, a polyester resin and a styrene-based polymer are preferable because they have an appropriate softening point of about 100° C. and exhibit good fixing property, and a styrene-based polymer is particularly preferable.

The styrene-based polymer is, for example, a homopolymer composed of only a styrene-based monomer, a copolymer or a copolymer of a styrene-based monomer and other vinyl-based monomers. Examples of the styrene-based monomers include styrene, p-chlorostyrene and vinylnaphthalene.

As the other vinyl-based monomers, ethylenically unsaturated monoolefins, such as ethylene, propylene, 1-butene and isobutene; vinyl halides, such as vinyl chloride, vinyl bromide and vinyl fluoride; vinyl esters, such as vinyl acetate, vinyl propionate, vinyl benzoate and vinyl butyrate; α-methylene aliphatic monocarboxylic acids, such as acrylic acid and methacrylic acid; esters of α-methylene aliphatic monocarboxylic acids, such as methyl acrylate, ethyl acrylate, n-butyl acrylate, isobutyl acrylate, n-octyl acrylate, dodecyl acrylate, 2-chloroethyl acrylate, phenyl acrylate, methyl α-chloroacrylate, methyl methacrylate, ethyl methacrylate and butyl methacrylate; nitriles and amides, such as acrylonitrile, methacrylonitrile and acrylamide; vinyl ethers, such as vinyl methyl ether, vinyl ethyl ether, vinyl propyl ether and vinyl isobutyl ether; vinyl ketones, such as vinyl methyl ketone, vinyl hexyl ketone and methyl isopropenyl ketone; N-vinyl compounds, such as N-vinylpyrrole, N-vinylcarbazole, N-vinylindole and N-vinylpyrrolidone; itaconic acid esters, such as dimethyl itaconate, dipropyl itaconate, dibutyl itaconate, dioctyl itaconate and diamyl itaconate; and others, such as maleic acid esters and fumaric acid esters, may be used, but not limiting thereto.

Of these vinyl monomers, esters of α-methylene aliphatic monocarboxylic acids are preferable.

The styrene-based polymers can be produced by using, as synthesis processes, publicly known polymerization processes, such as bulk polymerization, solution polymerization, suspension polymerization and emulsion polymerization.

<<Content of Ethylene Copolymer>>

In the toner of the present invention, the ethylene copolymer is generally contained in an amount of 0.1 to 40 parts by mass based on 100 parts by mass of the binder resin for a toner. The lower limit of the content of the ethylene copolymer is preferably 0.5 part by mass, more preferably 1.0 part by mass, still more preferably 1.5 parts by mass, particularly preferably 2.0 parts by mass. The upper limit thereof is preferably 35 parts by mass, more preferably 20 parts by mass, still more preferably 10 parts by mass, particularly preferably 6 parts by mass.

If the content of the ethylene copolymer is less than the above-mentioned lower limit, offset resistance and storage stability of the toner sometimes become insufficient. On the other hand, if the content thereof exceeds the upper limit, fixing property, particularly fixing stability with time after printing, becomes insufficient, that is, the printed character is liable to peel off from a paper surface, so that it sometimes useless for storage of information.

<<Colorant>>

Examples of the colorants contained in the toner of the present invention include black color pigments, such as carbon black, acetylene black, lamp black and magnetite; and organic pigments publicly known, such as chrome yellow, yellow iron oxide, Hansa Yellow G, quinoline yellow lake, permanent yellow NCG, molybdenum orange, Vulcan orange, indanthrene, brilliant orange GK, red iron oxide, brilliant carmine 6B, fulizarin lake, methyl violet lake, fast violet B, cobalt blue, alkali blue lake, phthalocyanine blue, fast sky blue, pigment green B, malachite green lake, titanium oxide and zinc white. The content of the colorant is usually 5 to 250 parts by mass based on 100 parts by mass of the binder resin for a toner.

<<Other Components>>

To the toner of the present invention, additives hitherto publicly known, e.g., polyvinyl chloride, polyvinyl acetate, polyolefin, polyester, polyvinyl butyral, polyurethane, polyamide, rosin, modified rosin, terpene resin, phenolic resin, aliphatic hydrocarbon resin, aromatic petroleum resin, paraffin wax, polyolefin wax (other than the ethylene-based polymer in the present invention), ceramic wax, natural waxes, such as rice wax, sugar wax, Urushi wax, beeswax, carnauba wax, candelilla wax and montan wax, fatty acid amide wax, polyvinyl chloride resin, styrene-butadiene resin, coumarone-indene resin and a mold release agent such as melamine resin, may be partially added and used within limits not detrimental to the effects of the present invention, when needed. The amount of such a component is usually 0.1 to 40 parts by mass based on 100 parts by mass of the binder resin for a toner.

Examples of monomers to constitute the polyolefin wax (other than the ethylene-based polymer in the present invention) include ethylene, propylene, 1-butene, 1-pentene and all of other olefin monomers. The polyolefin wax obtained from these monomers may be that of homopolymer type obtained from a single monomer or may be that of copolymer type obtained from two or more monomers. The polyolefin wax may be any of an unmodified polyolefin wax and a modified polyolefin wax obtained by block copolymerization or graft copolymerization of an olefin component with a modifying component. Examples of the modifying components in the modified polyolefin wax include aromatic monomers, such as styrene, methylstyrene, p-ethylstyrene and p,n-butylstyrene, monocarboxylic acid ester monomers, such as methyl (meth) acrylate and ethyl (meth)acrylate, dicarboxylic acids, such as maleic acid, fumaric acid, itaconic acid, crotonic acid, Nadic acid and methylhexahydrophthalic acid, and anhydrides, such as maleic anhydride, itaconic anhydride, citraconic anhydride, allylsuccinic anhydride, glutaconic anhydride and Nadic anhydride.

As the charge controlling agent, a publicly know charge controlling agent, such as nigrosine, quaternary ammonium salt or metal-containing azo dye, can be properly selected and used, and the amount of the charge controlling agent used is usually 0.1 to 10 parts by mass based on 100 parts by mass of the binder resin for a toner.

<Production Process for Electrophotographic Toner>

The toner of the present invention can be produced by adopting any of hitherto publicly known processes, such as contact dispersing, melt dispersing and solution dispersing of the above components.

For example, a binder resin for a toner, the ethylene copolymer, a colorant, a charge controlling agent, a mold release agent, etc. are premixed in advance by a mixing machine such as a ball mill or a Henschel mixer, thereafter the resulting mixture is kneaded by a heating kneading machine, such as a heating roll kneader or a single screw or twin-screw kneading machine, and the resulting kneadate is cooled and then pulverized by a pulverizer such as a hammer mill. The resulting pulverizate is further classified by an air classifier, and particles usually having diameters of 8 to 20 μm are collected to obtain a toner.

The toner of the present invention can be also produced by a process comprising a mixing step for mixing a resin particle dispersion obtained by dispersing resin particles in a dispersing agent, a colorant dispersion obtained by dispersing colorant particles in a dispersing agent and a mold release agent particle dispersion obtained by dispersing ethylene copolymer particles in a dispersing agent with one another, an aggregation step for forming aggregate particles having diameters corresponding to toner particle diameters, and a fusion step for fusing the aggregate particles by heating.

The toner of the present invention can be also produced by a process comprising a step of polymerizing a composition consisting of a polymerizable monomer, a colorant, an ethylene copolymer, a charge controlling agent, etc.

In the case of kneading by the use of the heating kneading machine, the heating melting conditions vary depending upon the properties of the binder resin for a toner, such as a melting point. For example, in the case of a polar group-containing vinyl polymer such as a styrene-acrylic resin, the resin temperature at the discharge section of a twin-screw kneading machine is preferably lower than 190° C., and the residence time is preferably less than 180 seconds. As a cooling method, a method of rapidly cooling by the use of a steel belt cooler or the like is preferable.

For carrying out the kneading, a method comprising kneading the ethylene copolymer with a binder resin for a toner under the conditions of a high content ratio of the ethylene copolymer to prepare a master batch in advance and further kneading the master batch with other components such as a binder resin for a toner and a colorant can be also mentioned. When the binder resin for a toner and the ethylene copolymer are relatively immiscible with each other, this method is effective.

In the preparation of the master batch, the ethylene-based polymer is incorporated in an amount of 5 to 900 parts by mass, preferably 5 to 300 parts by mass, more preferably 5 to 100 parts by mass, particularly preferably 5 to 50 parts by mass, based on 100 parts by mass of the binder resin for a toner.

<Characteristics of Electrophotographic Toner>

The reason why the toner of the present invention becomes excellent in storage property, offset resistance, fixing property during printing, blocking resistance, development durability and low-temperature printing property by incorporating the ethylene-based polymer is not clear, but the present inventors have presumed as follows.

It is considered that since the ethylene copolymer in the present invention has no polar group, it rarely absorbs moisture, and since the ethylene copolymer has low surface tension and is properly dispersed in a binder resin, it gives effects of excellent blocking resistance, development durability and offset resistance to the toner.

Further, when the ethylene copolymer having a narrow molecular weight distribution is used, it is expected that stickiness of the ethylene copolymer itself is further reduced. In this case, as previously described, such reduction of stickiness sometimes leads to more preferable toners having enhanced blocking resistance, development durability and offset resistance.

Furthermore, since the ethylene copolymer in the present invention is excellent in heat stability as previously described, it is rarely thermally decomposed even in the heating environment during toner production or printing. Therefore, the resulting toner is excellent in storage stability, and it can be expected that stain or dust inside a printer can be highly prevented.

Moreover, since the cyclic olefin contained in the ethylene copolymer in the present invention has a specific structure, high heat stability can be expected even if the content of the cyclic olefin is relatively small. Therefore, it is presumed that high crystalline property and high heat stability are compatible with each other and the resulting toner is highly excellent in a balance of various properties.

<Uses of Electrophotographic Toner>

Alconsideredhe uses of the toner of the present invention are not specifically restricted, the toner can be used also as a two-component or one and half-component developing agent by mixing it with a carrier, or can be used also as a magnetic one-component developing agent in which a magnetic powder is incorporated into the toner but a carrier is not used or as a one-component developing agent using no carrier or no magnetic powder or as a micro-toning developing agent. When the toner of the present invention is used as a two-component or one and half-component developing agent, any of hitherto publicly known carriers can be used as the carrier.

Examples of the carriers that can be used include magnetic powders, such as iron powder, ferrite powder and nickel powder, glass beads, and carriers obtained by treating surfaces of these powders or beads with resins.

Examples of the resins used for coating the carrier surfaces include a styrene/acrylic acid ester copolymer, a styrene/methacrylic acid ester copolymer, an acrylic acid ester copolymer, a methacrylic acid ester copolymer, a fluorine-containing resin, a silicon-containing resin, a polyamide resin, an ionomer resin, a polyphenylene sulfide resin, and mixtures thereof.

EXAMPLES

The present invention is more specifically described with reference to the following examples, but the present invention is in no way limited to those examples as long as the examples are within the spirit of the present invention.

Property values, etc. in the examples and the comparative examples were determined by the following measuring methods.

<Methods for Measuring Properties of Ethylene Copolymer>

(1) Method for Measuring Content of Constituent Unit

The content of a constituent unit derived from a cyclic olefin of an ethylene copolymer is obtained by comparing peak areas of carbons in the unsaturated portion with peak areas of all carbons through $^{13}$C-NMR.

Using an ECP500 type nuclear magnetic resonance apparatus manufactured by JEOL Ltd. and using an orthodichlorobenzene/deuterated benzene (80/20% by volume) mixed solvent as a solvent, measurement was carried out under the conditions of a sample concentration of 55 mg/0.6 mL, a measuring temperature of 120° C., an observed nucleus of $^{13}$C (125 MHz), a sequence of single pulse proton decoupling, a pulse width of 4.7 μsec (45° pulse), a repetition time of 5.5 sec, a cumulative number of times of not less than 10,000 and a chemical shift reference value of 27.50 ppm. Assignment of peaks and determination were carried out by conventional methods.

(2) Method for Measuring Intrinsic Viscosity [η]

About 20 mg of an ethylene copolymer was dissolved in 15 ml of decalin, and a specific viscosity $\eta_{sp}$ was measured in an oil bath at 135° C. To this decalin solution, 5 ml of a decalin solvent was added to dilute the solution, and a specific viscosity $\eta_{sp}$ was measured in the same manner as above. This dilution operation of adding 5 ml of a decalin solvent was further repeated twice, and a $\eta_{sp}/C$ value given when the concentration (C) was extrapolated to 0 was determined as an intrinsic viscosity [η] (unit: dl/g), as indicated by the following equation (Eq-6).

$$[\eta]=lim(\eta_{sp}/C)(C\rightarrow 0) \quad \text{(Eq-6)}$$

(3) Method for Measuring Crystallinity

A test sample was hot-pressed at 180° C. for 5 minutes and then cold-pressed by water cooling for 5 minutes to prepare a pressed sheet having a thickness of 1 mm. With regard to the resulting pressed sheet, an X-ray profile was measured by a transmission method using an X-ray diffraction apparatus having a rotary sample table (Rigaku RINT2500) under the conditions of 50 kV and 300 mA. From the resulting X-ray profile, a crystalline portion and a non-crystalline portion were separated from each other, and a crystallinity was determined.

(4) Method for Measuring Melting Point (Tm)

A melting point of an ethylene copolymer was measured by DSC-20 (manufactured by Seiko Electron Industry co., Ltd.) in accordance with differential scanning calorimetry (DSC). About 10 mg of a sample was placed in an aluminum pan and heated to 200° C. from −20° C. at 10° C./min, and an endothermic peak in the resulting curve was determined as a melting point. Prior to the measurement in temperature rise, the sample (copolymer) was subjected to operations of once heating the sample up to about 200° C., then maintaining it for 5 minutes and then cooling it down to −20° C. at 20° C./min to unify heat history of the sample (copolymer).

(5) Method for Measuring Molecular Weight Distribution (Mw/Mn)

A number-average molecular weight Mn and a weight-average molecular weight Mw of an ethylene copolymer were determined by GPC measurement. The measurement was carried out under the following conditions. Using commercially available monodisperse standard polystyrene, a calibration curve was made, and the number-average molecular weight Mn and the weight-average molecular weight Mw were determined based on the following conversion method.

Apparatus: gel permeation chromatograph Alliance GPC2000 type (manufactured by Waters Corporation) Solvent: o-dichlorobenzene Column: TSK gel Column (available from Tosoh Corporation)×4

Flow rate: 1.0 ml/min

Sample: 0.15 mg/mL, o-dichlorobenzene solution

Temperature: 140° C.

Molecular weight conversion: PE conversion/universal calibration method

In the calculation for the universal calibration, the following coefficients of the Mark-Houwink equations for viscosity were used.

Coefficient of polystyrene (PS): KPS=$1.38\times10^{-4}$, aPS=0.70

Coefficient of polyethylene (PE): KPE=$5.06\times10^{-4}$, aPE=0.70

(6) Measurement of 5% Weight Loss Temperature

In order to comprehend heat resistance of an ethylene copolymer in a toner binder, a 5% weight loss temperature was measured. The 5% weight loss temperature is a temperature measured by a thermogravimetric apparatus (TG-DTA320, manufactured by SII), at which 10 mg of an ethylene copolymer weighed is decreased in weight by 5%. Here, the measurement by TGA was carried out in an atmosphere of air under the conditions of an air flow rate of 200 mL/min, a heating rate of 20° C./min and a temperature range of 30° C. to 700° C.

<Methods for Measuring Properties of Toner Binder or Toner>

(1) Acid Value

An acid value in the examples was calculated in the following manner. A sample accurately weighed was dissolved in a mixed solvent of xylene:n-butanol (1:1 by mass). The solution was titrated with a previously standardized alcohol solution of N/10 potassium hydroxide (obtained by adding 5 g of ion-exchanged water to 7 g of special grade potassium hydroxide, adding primary ethyl alcohol to give a volume of 1 L (liter), a factor (=F) of the standardized alcohol solution is evaluated by using N/10 hydrochloric acid and a 1% phenolphthalein solution), and from the neutralization quantity, the acid value was calculated in accordance with the following formula.

$$\text{Acid value (mgKOH/g)}=(\text{N/10 KOH titer (ml)}\times F\times 5.61)/(\text{sample (g)}\times 0.01)$$

(2) Peak Molecular Weight

A peak molecular weight in the examples was determined by GPC (gel permeation chromatography), and is a molecular weight in terms of polystyrene obtained from a calibration curve prepared using monodisperse standard polystyrene. Peaks in the examples include shoulder peaks. The measuring conditions are as follows. From the sample solution, components insoluble in THF were removed by a filter immediately before the measurement.

GPC apparatus: SHODEX GPC SYSTEM-21 (Show Denko K.K.)

Detector: SHODEX RI SE-31 (Showa Denko K.K.)

Column: three SHODEX GPC KF-807L and one GPC KF-800D (Showa Denko K.K.)

Solvent: THF

Flow rate: 1.2 ml/min

Sample concentration: 0.002 g-resin/ml-THF

Injection quantity: 100 μl

In the measurement of a molecular weight of a toner, 10% by mass of a toner is sufficiently dissolved in 90% by mass of THF, then 50 parts by mass of SIMGON talc and 50 parts by mass of titanium (CR-95) were added, and the mixture was subjected to centrifugation. The resulting supernatant liquid was adjusted to a specific concentration, and the peak molecular weight was measured.

<Evaluation Methods for Toner>

(1) Low-temperature Fixing Property

Using a copy machine obtained by remodeling a commercially available electrophotographic copy machine, an unfixed image was formed. Thereafter, using a heating roller fixing apparatus obtained by remodeling a fixing section of a commercially available copy machine, this unfixed image was fixed under the conditions of a heating roller fixing rate of 190 mm/sec and a temperature of 130° C. The resulting fixed image was rubbed 6 times with an ink eraser (available from Tombow Pencil Co., Ltd.) under a load of 1.0 kgf. Before and after the rubbing, the image density was measured by a Macbeth reflection densitometer. A value calculated from the formula:

image density after rubbing÷image density before rubbing×100 was taken as a change ratio at that temperature. A mean value of change ratios at 130° C. was calculated as a fixing ratio. The heating roller fixing apparatus used herein was an apparatus having no silicone oil feed mechanism. As the environmental conditions, ordinary temperature and normal pressure (temperature: 22° C., relative humidity: 55%) were set.

(Evaluation Criteria)

◎: 42%≤fixing ratio

○: 39%≤fixing ratio <42%

Δ: 35%≤fixing ratio <39% x: fixing ratio <35%

(2) Low-temperature Offset Property

Evaluation of low-temperature offset property was carried out in accordance with the above measurement of the lowest fixing temperature. That is to say, an unfixed image was formed by the above copy machine, then the toner image was transferred, and fixing was carried out using the above heating roller fixing apparatus. Thereafter, whether toner staining occurred on the non-image portion or not was observed. These operations were repeated, while the preset temperature of the heating roller of the heating roller fixing apparatus was successively lowered from 150° C. A preset temperature at which staining with toner had occurred was taken as an offset occurrence temperature, and the low-temperature offset property was evaluated by the offset occurrence temperature on the low temperature side. In an atmosphere surrounding the copy machine, the temperature was set at 22° C., and the relative humidity was set at 55%.

(Evaluation Criteria)

◎: offset occurrence temperature <130° C.

○: 130° C.≤offset occurrence temperature <135° C.

Δ: 135° C.≤offset occurrence temperature <140° C.

x: 140° C.≤offset occurrence temperature (3) High-temperature Offset Property

Evaluation of high-temperature offset property was carried out in accordance with the above measurement of the lowest fixing temperature. That is to say, an unfixed image was formed by the above copy machine, then the toner image was transferred, and fixing was carried out by the above heating roller fixing apparatus. Thereafter, whether toner staining occurred on the non-image portion or not was observed. These operations were repeated, while the preset temperature of the heating roller of the heating roller fixing apparatus was successively raised from 190° C. A preset temperature at which staining with toner had occurred was taken as an offset occurrence temperature. In an atmosphere surrounding the copy machine, the temperature was set at 22° C., and the relative humidity was set at 55%.

(Evaluation Criteria)

◎: 220° C.≤offset occurrence temperature

○: 210° C.≤offset occurrence temperature <220° C.

Δ: 200° C.≤offset occurrence temperature <210° C.

x: offset occurrence temperature <200° C.

(4) Storage Property

On a sieve of 150 meshes, 5 g of a toner having been allowed to stand for 24 hours under the environmental conditions of a temperature of 50° C. and a relative humidity of 60% was placed, then the scale of a rheostat of a powder tester (Hosokawa Powder Engineering Research Institute) was adjusted to 3, and the sieve was vibrated for one minute. After the vibration, the amount (mass) of the toner remaining on the sieve of 150 meshes was measured to determine a residue mass ratio.

(Evaluation Criteria)

◎: residue mass ratio <45%

○: 45%≤residue mass ratio <65%

Δ: 65%≤residue mass ratio <75% x: 75%≤residue mass ratio (5) Odor

Odor generated from a toner was evaluated in accordance with the following criteria.

In a test tube of 18 ml, 1 g of a toner was placed, and the test tube was allowed to stand still for 30 minutes in an aluminum block heater DRY THERMOUNIT T-543 (TAITEC Corporation) heated to 150° C. A sensor part of an odor sensor XP-329 (New Cosmos Electric Co., Ltd.) was brought close to the mouth of the test tube, and a stable numerical value obtained after 1 minute was taken as a measured value. The indicated value of the odor sensor is a difference (increment) between a value of odor in the atmosphere measured by the odor sensor (reference value) and the aforesaid measured value.

◎: indicated value of odor sensor <145

○: 145≤indicated value of odor sensor <155

Δ: 155≤indicated value of odor sensor <170 x: 170≤indicated value of odor sensor

Preparation Example for Toner Binder

Preparation Example for Low-molecular Weight Vinyl Resin (L-1)

Preparation Example L-1

In a flask purged with nitrogen, 100 parts by mass of mixed xylene were placed and heated, and under reflux of xylene, a mixed solution obtained by mixing and dissolving 93 parts by mass of styrene, 6 parts by mass of n-butyl acrylate and 1 part by mass of methacrylic acid in 10 parts by mass of t-butyl peroxy-2-ethylhexanoate was continuously added over a period of 5 hours, followed by further continuing refluxing for 1 hour. Thereafter, the internal temperature was maintained at 98° C., then 0.5 part by mass of t-butyl peroxy-2-ethylhexanoate was further added, and the reaction was continued for 1 hour. Furthermore, 0.5 part by mass of t-butyl peroxy-2-ethylhexanoate was added, and the reaction was continued for 2 hours to obtain a polymer solution of a low-molecular weight vinyl resin L-1 having a peak molecular weight of 4600 and an acid value of 6.5 mgKOH/g.

Preparation Example for High-molecular Weight Vinyl Resin (H-1)

Preparation Example H-1

In a flask purged with nitrogen, 74 parts by mass of styrene, 23.5 parts by mass of n-butyl acrylate and 2.5 parts by mass of methacrylic acid were placed, and the internal temperature was raised to 120° C. Thereafter, the temperature was maintained at the same temperature, and bulk polymerization was carried out for 8 hours. Subsequently, 50 parts by mass of mixed xylene were added, then 0.2 part by mass of tetraethylene glycol diacrylate was added, and the temperature was raised to 110° C. Then, 0.35 part by mass of 1,1-bis(t-butylperoxy)cyclohexane and 60 parts by mass of mixed xylene, which had been mixed and dissolved in advance, were continuously added over a period of 9 hours while maintaining the temperature at 110° C., and thereafter, the reaction was continued for 1 hour. Then, 0.21 part by mass of 1,1-bis(t-butylperoxy)cyclohexane was added, and the reaction was continued for 2 hours. Further, 0.52 part by mass of 1,1-bis(t-butylperoxy)cyclohexane was added, and the reaction was continued for 2 hours to complete polymerization. Thus, a polymer solution of a high-molecular weight vinyl resin H-1 having a peak molecular weight of 300000 and an acid value of 16.3 mgKOH/g was obtained.

Preparation Example for Binder Resin (C-1)

Preparation Example C-1

The polymer solutions obtained above were mixed so that the amount of the high-molecular weight vinyl resin (H-1) might become 50 parts by mass and the amount of the low-molecular weight vinyl resin (L-1) might become 50 parts by mass, and thereafter, the mixture was subjected to flash distillation in a vessel (container) at 190° C. and 1.33 kPa to remove the solvent, etc. Thus, a binder resin C-1 having a first peak molecular weight of 4600, a second peak molecular weight of 300000 and an acid value of 11.4 mgKOH/g was obtained.

Polymerization Example for Ethylene Copolymer

Synthesis Example 1

Using a 0.95 L continuous polymerizer equipped with a stirrer, polymerization was carried out. This autoclave was a flooded type autoclave. To the autoclave were continuously fed, per unit time, 1060 g of hexane, 8 NL of hydrogen, 100 NL of ethylene, 15.4 g of 5-ethylidene-2-norbornene, 0.0004 g of bis(n-butylcyclopentadienyl)zirconium dimethyl, 0.0026 g of N,N-dimethylanilinium tetrakis(pentafluorodiphenyl)borate and 0.0185 g of triisobutylaluminum, and the temperature, the pressure and the stirring rotation speed were maintained at 150° C., 3.6 MPa and 800 rpm, respectively. The polymer solution was continuously discharged for 1 hour. To the resulting polymer solution, methanol was added to terminate the polymerization. The polymer solution was taken out, and the polymer solution was dried under a stream of nitrogen to obtain 70 g of a polymer.

Subsequently, using a thin film distillation apparatus (manufactured by Kobelco Eco-Solutions Co., Ltd., 2-03 type, heat transfer area: 0.03 $m^2$), a low-molecular weight component was removed under the conditions of a temperature of 190° C., a pressure of 0.08 Torr and a polymer feed rate of 2.9 g/min to obtain 56 g of a distillate [ethylene copolymer (E−1)]. The property measurement results are set forth in Table 1.

Synthesis Example 2

A distillate [ethylene copolymer (E-2)] of 48 g was obtained by removing a low-molecular weight component in the same manner as in Synthesis Example 1, except that in the thin film distillation, the temperature was changed to 240° C. and the polymer feed rate was changed to 2.7 g/min. The property measurement results are set forth in Table 1.

Synthesis Example 3

Polymerization was carried out in the same manner as in Synthesis Example 1. Without subjecting the resulting polymer solution to drying under a stream of nitrogen and thin film distillation, the polymer solution was introduced into acetone, and they were stirred. The mixed solution was subjected to vacuum filtration to obtain a solid (polymer), and the solid was dried to obtain 65 g of an ethylene copolymer (E-3). The property measurement results are set forth in Table 1.

Synthesis Example 4

Polymerization and termination reaction were carried out in the same manner as in Synthesis Example 1, except that the amounts of hexane, hydrogen and 5-ethylidene-2-norbornene fed per unit time in the polymerization were changed to 1010 g, 6 NL and 81.4 g, respectively. As a result, 115 g of a polymer was obtained.

Subsequently, using a thin film distillation apparatus (manufactured by Kobelco Eco-Solutions Co., Ltd., 2-03 type, heat transfer area: 0.03 $m^2$), a low-molecular weight component was removed under the conditions of a temperature of 300° C., a pressure of 0.10 Torr and a polymer feed rate of 2.8 g/min to obtain 83 g of a distillate [ethylene copolymer (E-4)]. The property measurement results are set forth in Table 1.

Synthesis Example 5

In a glass flask having an internal volume of 1.0 L, which had been thoroughly purged with nitrogen, 0.6 L of toluene and 10.0 g of 2-norbornene were placed, and while carrying out stirring at a stirring speed of 800 rpm, the temperature in the system was raised up to 85° C. Thereafter, ethylene was passed through at a rate of 120 L/hr, and hydrogen was passed through at a rate of 24 L/hr. Subsequently, 0.6 mmol of triisobutylaluminum was added, and 0.025 mmol of bis(n-butylcyclopentadienyl) zirconium dimethyl and 0.05 mmol of N,N-dimethylanilinium tetrakis(pentafluorodiphenyl)borate were further added to initiate polymerization. While continuously adding ethylene and carrying out stirring at a stirring speed of 800 rpm, polymerization was carried out for 30 minutes at 85° C. and normal pressure. A small amount of isobutyl alcohol was added to the system to terminate polymerization, and thereafter, the resulting polymer solution was poured into a large amount of acetone to precipitate a polymer. The resulting polymer was recovered by filtration and dried for one night at 80° C. under reduced pressure. As a result, 6.0 g of an ethylene copolymer (E-5) was obtained. The property measurement results are set forth in Table 1.

Preparation Example for Toner

Example 1

To 100 parts by mass of the binder resin C-1, 6 parts by mass of carbon black (MA100, available from Mitsubishi Kasei Corporation), 2.5 parts by mass of the ethylene copolymer obtained in Synthesis Example 1 and 0.5 part by mass of a charge controlling agent (T-77, available from Hodogaya Chemical Co., Ltd.) were added, then they were mixed by a Henschel mixer, and thereafter, the mixture was kneaded by a twin-screw kneader (PCM-30 type, manufactured by Ikegai Kikai Co., Ltd.) at a twin-screw kneader discharge section resin temperature of 120° C. for a residence time of 30 seconds. Subsequently, the kneadate was cooled, pulverized and classified to obtain a toner. The evaluation results of the resulting toner are set forth in Table 1.

Examples 2 to 4

Toners were obtained in the same manner as in Example 1, except that the ethylene copolymers obtained in Synthesis Example 2 to 4 were each used instead of the ethylene copolymer used in Example 1. The evaluation results of the resulting toners are set forth in Table 1.

Comparative Example 1

A toner was obtained in the same manner as in Example 1, except that Hi-WAX 110P (trade name, available from Mitsui Chemicals, Inc, ethylene: 93.6% by mol, propylene: 6.4% by mol) having no constituent unit derived from a cyclic olefin of 8 or more carbon atoms was used instead of the ethylene copolymer used in Example 1. The evaluation results of the resulting toner are set forth in Table 1.

Comparative Example 2

A toner was obtained in the same manner as in Example 1, except that Hi-WAX NP105 (trade name, available from Mitsui Chemicals, Inc, propylene: 97.3% by mol, ethylene: 2.7% by mol) having no constituent unit derived from a cyclic olefin of 8 or more carbon atoms was used instead of the ethylene copolymer used in Example 1. The evaluation results of the resulting toner are set forth in Table 1.

Comparative Example 3

A toner was obtained in the same manner as in Example 1, except that the ethylene copolymer obtained in Synthesis Example 5 was used instead of the ethylene copolymer used in Example 1. The evaluation results of the resulting toner are set forth in Table 1.

TABLE 1

| | | | Ex. 1 | Ex. 2 | Ex. 3 | Ex. 4 | Comp. Ex. 1 | Comp. Ex. 2 | Comp. Ex. 3 |
|---|---|---|---|---|---|---|---|---|---|
| Ethylene copolymer | | | E-1 | E-2 | E-3 | E-4 | 110P | NP105 | E-5 |
| Constituent unit (a) | Ethylene | mol % | 97.1 | 97.5 | 98 | 92.8 | 93.6 | 2.7 | 91.5 |
| Constituent unit (b) | ENB | mol % | 2.9 | 2.5 | 2 | 7.8 | 0 | 0 | 0 |
| Other constituent units | Propylene | mol % | 0 | 0 | 0 | 0 | 6.4 | 97.3 | 0 |
| | NB | mol % | 0 | 0 | 0 | 0 | 0 | 0 | 8.5 |
| Properties of ethylene copolymer | Intrinsic viscosity [η] | dl/g | 0.04 | 0.05 | 0.05 | 0.07 | 0.07 | 0.17 | 0.07 |
| | Crystallinity | % | 79 | 79 | 85 | 51 | 80 | 64 | 40 |
| | Melting point | ° C. | 76 | 82 | 74 | 83 | 96 | 141 | 88 |
| | Mw | — | 870 | 990 | 900 | 1420 | 1220 | 11000 | 1470 |
| | Mn | — | 580 | 720 | 600 | 1000 | 630 | 2960 | 810 |
| | Mw/Mn | — | 1.5 | 1.4 | 1.5 | 1.4 | 1.9 | 3.7 | 1.8 |
| | 5% weight loss temperature | ° C. | 310 | 325 | 297 | 353 | 275 | 305 | 308 |
| Evaluation of toner | Low-temperature fixing ratio | — | ◎ | ◎ | ◎ | ○ | Δ | X | Δ |
| | Low-temperature offset property | — | ○ | ○ | ○ | ○ | Δ | X | ○ |
| | High-temperature offset property | — | ○ | ○ | ○ | ○ | ○ | ◎ | ○ |
| | Storage property | — | ○ | ○ | ○ | ○ | ○ | ◎ | Δ |
| | Odor | — | ◎ | ◎ | ◎ | ◎ | Δ | Δ | ○ |

The invention claimed is:

1. An electrophotographic toner containing an ethylene copolymer which comprises a constituent unit (a) derived from ethylene in an amount of 80 to 99.5% by mol and a constituent unit (b) derived from a cyclic olefin of 8 or more carbon atoms in an amount of 0.5 to 20% by mol [(a)+(b)=100% by mol] and satisfies the following requirements (i) and (ii):

(i) the intrinsic viscosity [η] is in the range of 0.01 to 0.50 dl/g, and (ii) the crystallinity is in the range of 50 to 90%.

2. The electrophotographic toner as claimed in claim 1, wherein the ethylene copolymer further satisfies the following requirements (iii) and (iv):

(iii) the melting point (Tm) as measured by a differential scanning calorimeter (DSC) is in the range of 50 to 100° C., and (iv) the molecular weight distribution (Mw/Mn) as measured by GPC is in the range of 1 to 3.

3. The electrophotographic toner as claimed in claim 1, wherein the constituent unit (b) derived from a cyclic olefin of 8 or more carbon atoms contains 2 or more double bonds.

4. The electrophotographic toner as claimed in claim 1, wherein the constituent unit (b) derived from a cyclic olefin of 8 or more carbon atoms contains a repeating unit represented by the following general formula (V):

[Chem. 1] (V)

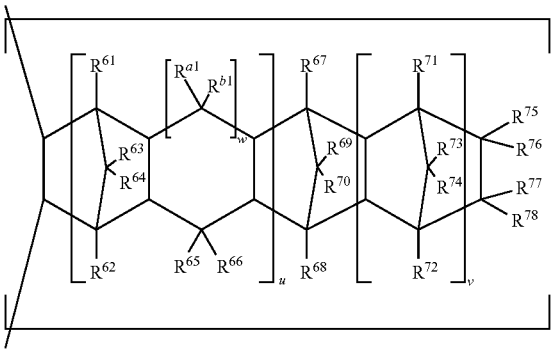

wherein u is 0 or 1, v is 0 or a positive integer, w is 0 or 1, $R^{61}$ to $R^{78}$, $R^{a1}$ and $R^{b1}$ may be the same as or different from one another and are each a hydrogen atom, a halogen atom, an alkyl group of 1 to 20 carbon atoms, an alkenyl group of 1 to 20 carbon atoms, a halogenated alkyl group of 1 to 20 carbon atoms, a cycloalkyl group of 3 to 15 carbon atoms or an aromatic hydrocarbon group of 6 to 20 carbon atoms, and $R^{75}$ to $R^{78}$ may be bonded to each other to form a monocyclic ring, a polycyclic ring or a multiple bond, but when u and v are both 0, at least one of $R^{67}$ to $R^{70}$ and $R^{75}$ to $R^{78}$ is an alkenyl group or a multiple bond other than a hydrogen atom.

5. The electrophotographic toner as claimed in claim 1, wherein the constituent unit (b) derived from a cyclic olefin of 8 or more carbon atoms is derived from ethylidene norbornene (ENB) or vinyl norbornene (VNB).

6. The electrophotographic toner in claim 1, wherein the electrophotographic toner further contains a polyester resin or a styrene-based polymer as a binder resin.

* * * * *